United States Patent [19]

Beswick

[11] Patent Number: 5,022,165

[45] Date of Patent: Jun. 11, 1991

[54] STERILIZATION TUNNEL

[75] Inventor: Frank Beswick, Phoenixville, Pa.

[73] Assignee: The West Company, Incorporated, Phoenixville, Pa.

[21] Appl. No.: 546,587

[22] Filed: Jun. 29, 1990

[51] Int. Cl.[5] ..... F26B 19/00

[52] U.S. Cl. ..... 34/62; 422/115; 34/105

[58] Field of Search ..... 34/60, 19, 90, 12, 13, 34/104, 105, 61, 62; 422/113, 187, 307, 308, 26, 112, 115

*Primary Examiner*—Henry A. Bennet
*Attorney, Agent, or Firm*—Eugene E. Renz, Jr.

[57] ABSTRACT

Apparatus for sterilizing objects, including an enclosed chamber having an inlet and an outlet. Also included are walls defining and separately enclosing a preheat zone, a sterilization zone and cooling zone respectively between the inlet and the outlet. The preheat zone includes an exhaust stack for discharging air from the apparatus. The exhaust unit has a temperature sensor for adjusting the amount of exhaust air based upon the temperature in the exhaust stack. The cooling zone includes a recirculating device for directing air from the cooling zone to the preheat zone. It also includes a regulator to control the amount of air directed by the recirculating device, based upon air pressure in the cooling zone.

15 Claims, 5 Drawing Sheets

STERILIZATION TUNNEL

FIELD OF THE INVENTION

The present invention relates to an apparatus for sterilizing objects such as glass bottles and other pharmaceutical containers. More particularly, the invention relates to an apparatus for sterilizing objects in an enclosed chamber. A conveyor transports objects to be sterilized along a path from the inlet to the outlet of the chamber while subjecting the objects to an elevated temperature.

BACKGROUND OF THE INVENTION

Sterilization has become an important part of many manufacturing industries. For example, in the pharmaceutical industry, it has become known to pass glass vials and bottles into the path of very hot air by carrying the objects on a moving conveyor belt. These bottles are then subjected to temperatures up to about 350° C. in order to meet the requirements for use in pharmaceutical applications. These standards are perhaps as strict as in any industry where sterilization is employed.

One such device for sterilizing ampules and other pharmaceutical containers is disclosed in Hortig et al, U.S. Pat. No. 3,977,091. Hortig et al teach that laminar flow is needed to reduce contamination by particles which might be otherwise blown about. Laminar flow is achieved by means of distribution plates which cooperate with the air supply means to produce laminar flow downwardly over the objects being treated, such as by heat for sterilization. Hortig et al solve the problem of laminar flow of conditioned air, but that is as far as this prior art patent goes. There is no recognition of any need to provide a complete system to treat the sterilized objects before and after sterilization. The patent does not recognize that some form of heat balance is necessary, particularly when the equipment is used in conjunction with other operations.

Another apparatus for sterilizing containers such as bottles and vials for the pharmaceutical industry is disclosed in Sfondrini et al, U.S. Pat. No. 4,597,192. Sfondrini et al discloses apparatus with a preheat chamber and a coolant chamber on either side of a sterilization chamber. The sterilization chamber itself contains an endless belt which transfers bottles and the like from the wash station onto a discharge for further processing, such as by filling and the like. In Sfrondini et al, pressure is maintained in an outer jacket at a point below the pressure in the sterilization chamber, so that no air will enter the plenum chamber filter system during sterilization step. Air leaves the sterilization environment through a conveyor belt and is drawn upward toward the suction of a fan to return through an outer jacket to the electrical resistance heaters. It is then recycled to the filters, completing a closed air cycle.

One difficulty which is not disclosed in Sfondrini et al but which is a problem arises because the sterilization chamber is operated at a higher pressure than the surrounding environment. The design also relies upon heat from the sterilization chamber to be transferred to the preheat chamber at the inlet of the device. Often times, when such a device is placed adjacent the discharge end of a washing machine, such as a bottle washer, a phenomenon known as blow back occurs. Unless pressure is vented from the preheat zone, 350° C. air can escape back into the washer equipment, melting plastics and other heat sensitive materials and generally damaging or disrupting the washing process.

Another difficulty with prior art devices is that the cooling zone often operates at an even greater pressure than the sterilization zone. Thus, when the pressure becomes excessive in the cooling zone, blow back into the sterilization zone causes a drop in temperature, thereby reducing the effectiveness of the sterilization process. It also causes a greater likelihood of blow back into the preheat zone and ultimately may cause damage to the washer or other equipment preceding the sterilization device itself.

Accordingly, it would be of great benefit to the art if a sterilizing tunnel design could be developed which would be self regulating to bypass excessive pressure and avoid damage to the process and equipment. Specifically, it is an object of the present invention to provide a system which avoids excessive overpressure between stations in the sterilization process. Thus, cool air will no longer infiltrate the sterilization or heating zone sufficiently to reduce the sterilization process. Moreover, the hot air which escapes the hot zone or sterilization zone into the preheat zone will not be permitted to raise the temperature excessively, thereby eliminating blow back into washer equipment and other preprocess equipment.

Other objects will appear hereinafter.

SUMMARY OF THE INVENTION

It has now been discovered that the above and other objects of the present invention may be accomplished in the following manner. Specifically, a new apparatus for sterilizing objects has been developed.

The apparatus includes an enclosed chamber having an inlet and an outlet. The chamber includes a plurality of walls defining and separately enclosing an inlet zone, a sterilization zone, and a cooling zone respectively, between the inlet and outlet. A conveyor means is provided for conveying objects along a path from the inlet through each of the zones to the outlet.

The inlet zone of the apparatus of the present invention includes an air inlet means. The inlet zone also includes means for directing this air against objects on the path, preferably through porous plates which create laminar flow. The inlet zone also includes an exhaust means for discharging air from the apparatus. The exhaust means includes a temperature sensor means which is suitable for adjusting the amount of exhaust air based upon a predetermined temperature in the inlet zone.

Also included is a sterilization zone in which heated filtered air from within the zone is directed onto objects passing on the conveyor means. The cooling zone includes means for directing air which has been cooled from within the zone onto objects. Recirculating means are providing for directing air from the cooling zone to the preheat zone exhaust means and to the regulating means to control the amount of air which is directed by the recirculating means based upon air pressure in the cooling zone.

In a preferred embodiment, the apparatus includes gate means between the inlet zone and the sterilization zone to regulate the size of the conveyor path height for different objects carried on the path. In addition, the preferred embodiment includes gate means between the sterilization zone and the cooling zone to again regulate the size of the conveyor path height for different objects carried on the path.

In a preferred system, the sterilization zone includes resistance heating coil means for heating air in the zone. Similarly, the cooling zone includes cooling coils and a fan for drawing air across the cooling coils.

For effective operation, it has also been found to be preferred to include dead plate means at both the inlet and the outlet for respectively transferring objects onto and off of the conveyor.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
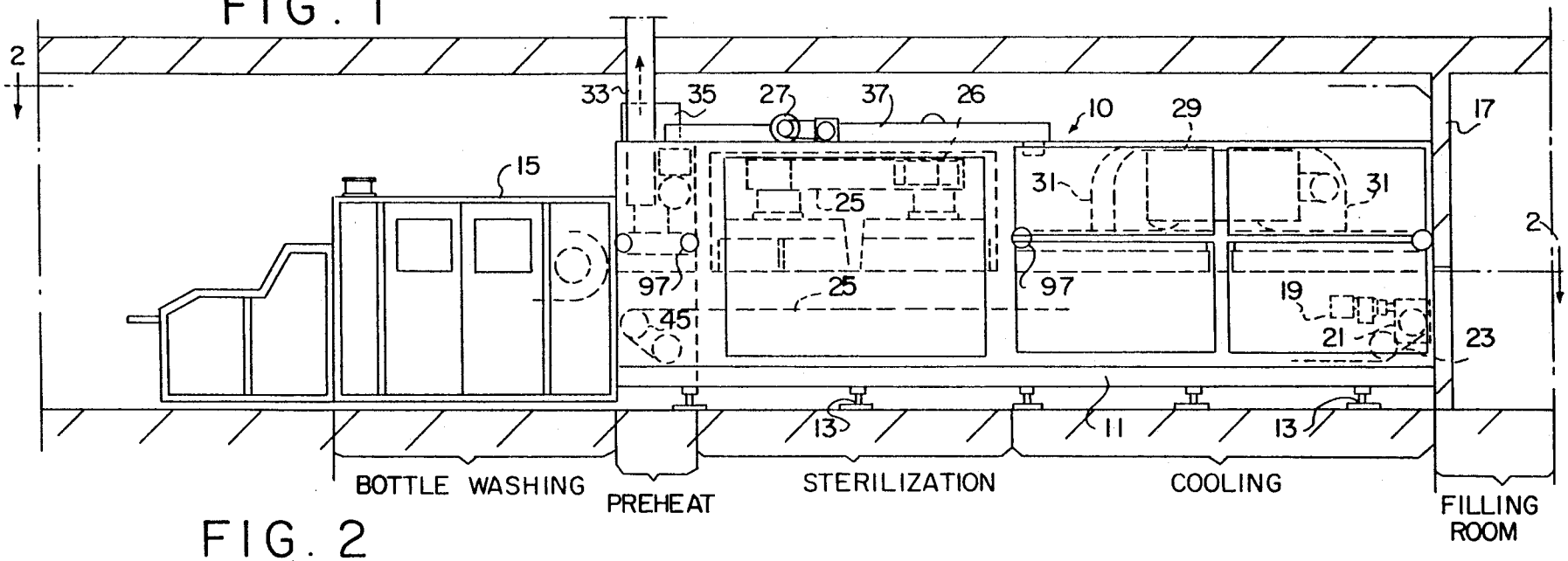
FIG. 1 is a schematic, side elevational view of both the precursor bottle washer, and the sterilizing tunnel of the present invention, both of which are in relationship to a wall dividing the bottle washing room from a sterilizing filling room.

As shown in FIG. 1, the sterilization tunnel device shown generally by the reference numeral 10 is mounted on frame 11, which in turn is supported by adjustable legs 13. Product flows through the sterilization tunnel from left to right, proceeding from a bottle washing unit 15 in this instance, through the preheat, sterilization and cooling zones of the sterilization tunnel and out through wall 17 to a filling room or other processing apparatus.

The product conveying system is driven by motor and transmission 19 which drives sprocket 21 and continuous chain 23 to define a continuous path from the inlet or left hand side of the unit to the outlet or right hand side.

Sterilization is accomplished in the sterilization zone where a centrifugal fan 25 draws air from heater 26 and is powered by fan motor 27. Similarly, cooling coils 29 cool air which is drawn by cooling fan motor and assembly 31.

Exhaust stack 33 discharges air from the sterilization unit. Similarly, inlet stack 35 allows filtered air to be drawn into the system and mixed with air from the transfer duct 37, as will be described hereinafter.

Figure 3A:
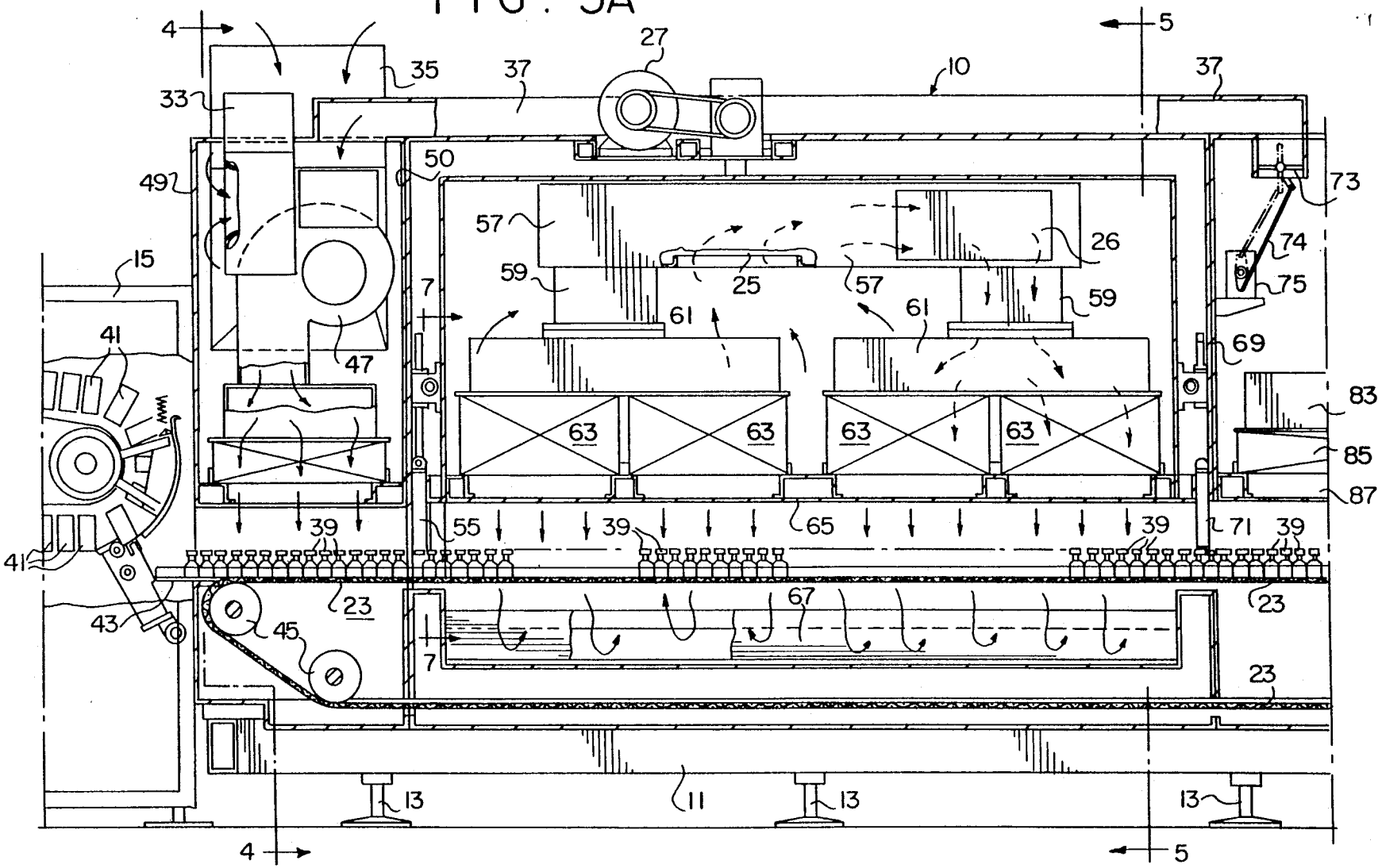
FIG. 3*a* is an enlarged fragmentary sectional elevational view taken along the lines 3*a*—3*a* of FIG. 2.
Figure 4:
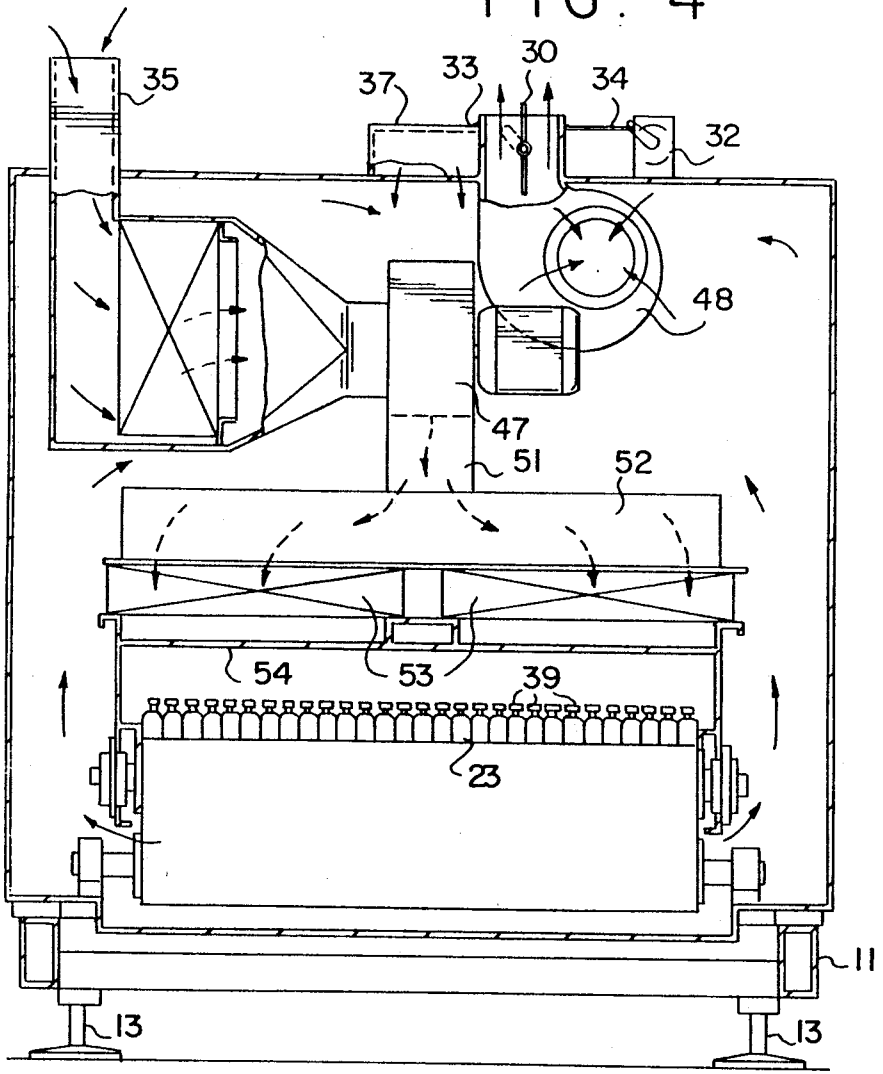
FIG. 4 is a transverse sectional elevational view taken on the line 4—4 of FIG. 3*a*, showing additional details of the preheater portion of the sterilizing tunnel.
Figure 6:
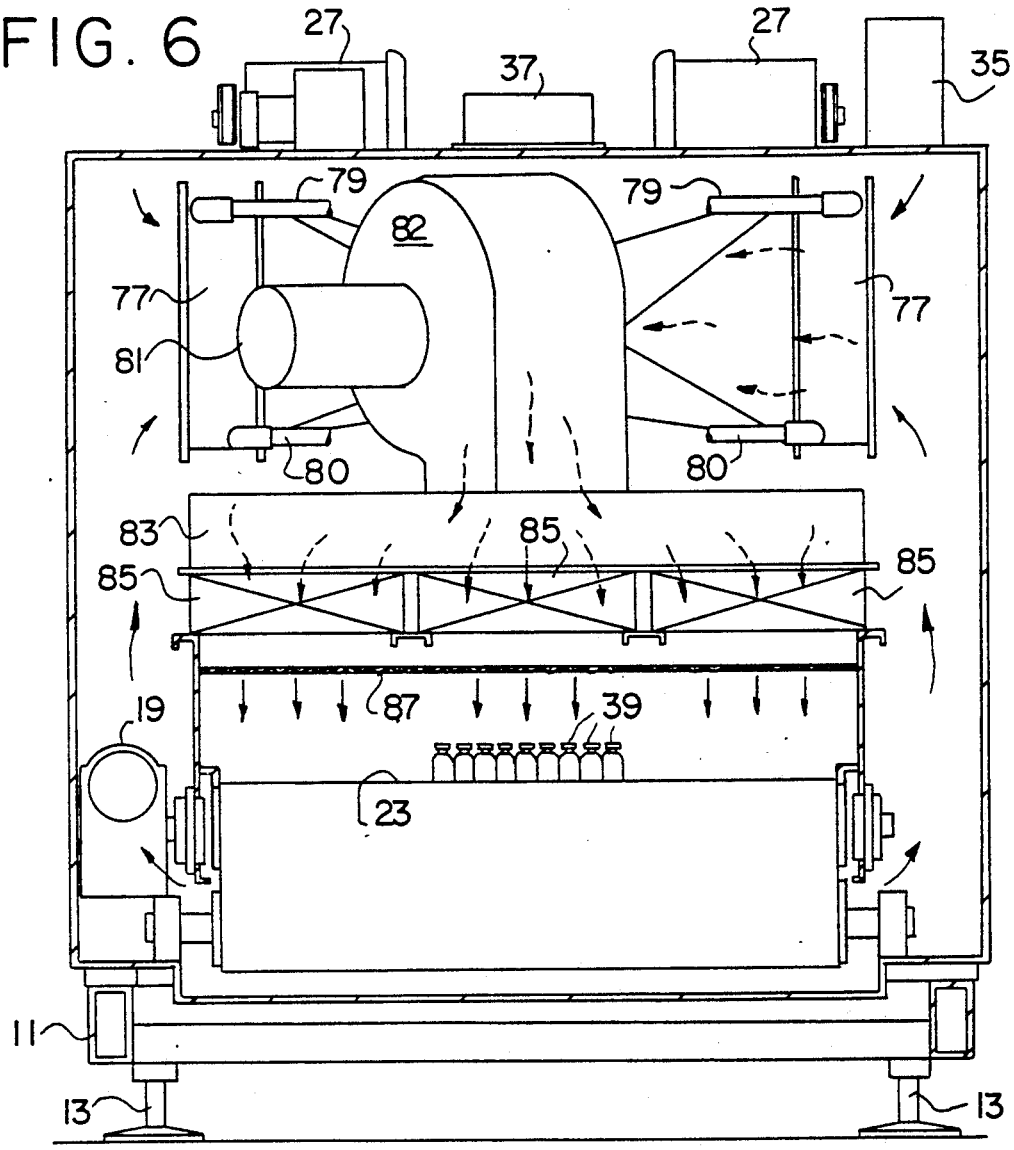
FIG. 6 is a transverse sectional elevational taken along the lines 6—6 of FIG. 3*b*, showing additional details of the cooling portion of the tunnel.

Turning now to the preheat zone, as is best seen in FIG. 3*a* and FIG. 4, bottles 39 enter the preheat zone, in this case from bottle washing cup members 41, which are indexed along a path during the washing process and which ultimately deposit bottles 39 on dead plate 43. As additional bottles are transferred to the dead plate 43, they reach the continuous, porous chain 23 as it turns about sprockets 45. Bottles 39 carried on the chain belt 23 in the preheat zone are subjected to a preheat or warming process as preheat fan 47 draws filtered air into the system in stack 35. Air in stack 35 can come from the surrounding environment, or it can come from the bottle washer unit 15.

Filtered air leaves the preheat fan 47 through fan exhaust 51 and enters plenum chamber 52, flowing through filters 53 and perforated distribution plate 54 so that air which has been warmed to an appropriate temperature impacts on bottles 39 as they are carried by the conveyor 23 through the preheat zone. Circulated air is then removed exhaust fan 48 out stack 33.

As shown in FIG. 4, a baffle 30 is located in exhaust stack 33 so that air can be withdrawn from the interior of the preheat zone when temperature sensed by temperature sensor 32 exceeds a predetermined value. Linkage 34 connected to sensor 32 adjusts the position of baffle 30 in exhaust stack 33.

In operation, the blower 47 causes a flow of air in the preheat zone. Air leaving the preheat zone is controlled by baffle 30 which is in turn controlled by the motorized temperature sensor 32. Baffle or damper 30 does not completely close but allows a partial flow of air out of the system.

The damper or baffle 30 opens as the temperature rises, and in a preferred embodiment will be fully open at approximately 80° C. This will prevent damage inside the housing. This high temperature will be caused by voids between product passing along on the conveyor 23 or by improperly set gates as will be described hereinafter. Under either circumstance, the downstream air is moved toward the preheat zone and is heated in the hot zone, thereby causing a quantity of hot air to enter the preheat zone. This is to be avoided.

The large quantity of cooler preheat blower air will maintain an adequate temperature as long as only a minimum amount of hot air from the sterilization zone enters the preheat zone. For this reason, if damper 30 were to remain fully open, it would pull more hot air out of the sterilization or hot zone, causing a greater differential in pressure between the two zones. Similarly, if the damper would be remained closed, there would be inadequate circulation of cool air and again the pressurized hot zone air would cause overheating. A proper damper position would be achieved at steady state operation, where temperature and air flow is balanced. This will be controlled by the controller sensor 32 which moves the baffle or damper 30 via connector 34 as previously described.

Figure 2:
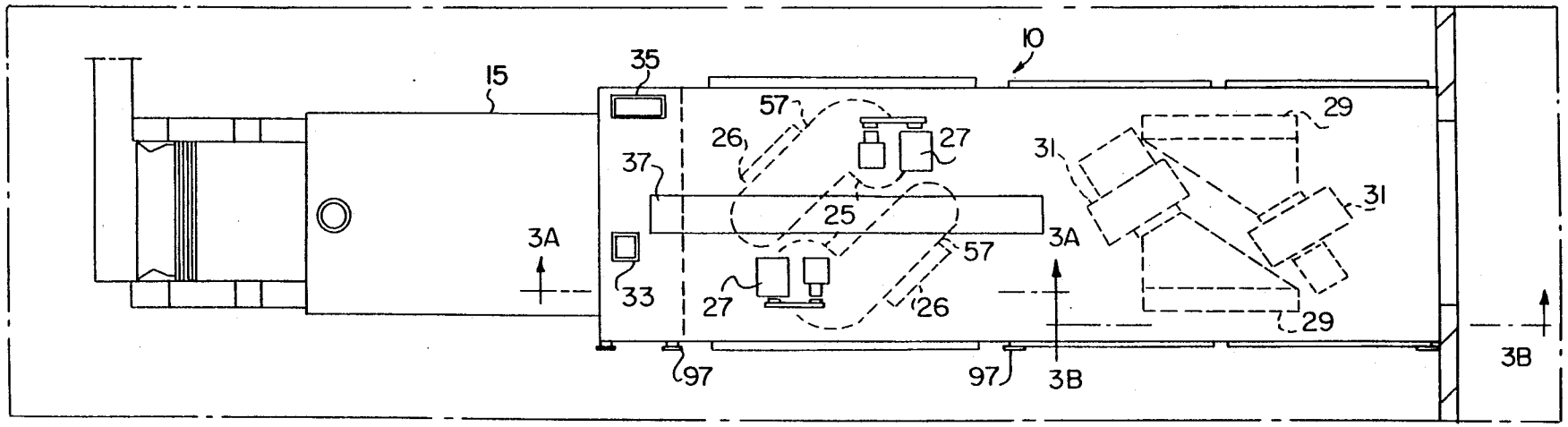
FIG. 2 is a sectional, plan view taken along the line 2,2 of FIG. 1, showing additional details of the assembly.

Turning now to the sterilization zone, the bottles 39 leave the preheat zone by passing under an adjustable gate 55 in wall 50 with the gate being adjusted to provide minimum necessary clearance between the bottle and the bottom of the gate. Air in the zone is drawn into duct 57 and delivered to manifolds 59. As can be seen in FIG. 2, heater 26 is adjacent duct 57 and this heater heats the air to a temperature of at least 300° to 350° C. Heaters 26 can be set to limit the temperature to which the air is subjected, because filters and other equipment limit the maximum temperature that can be used.

Figure 5:
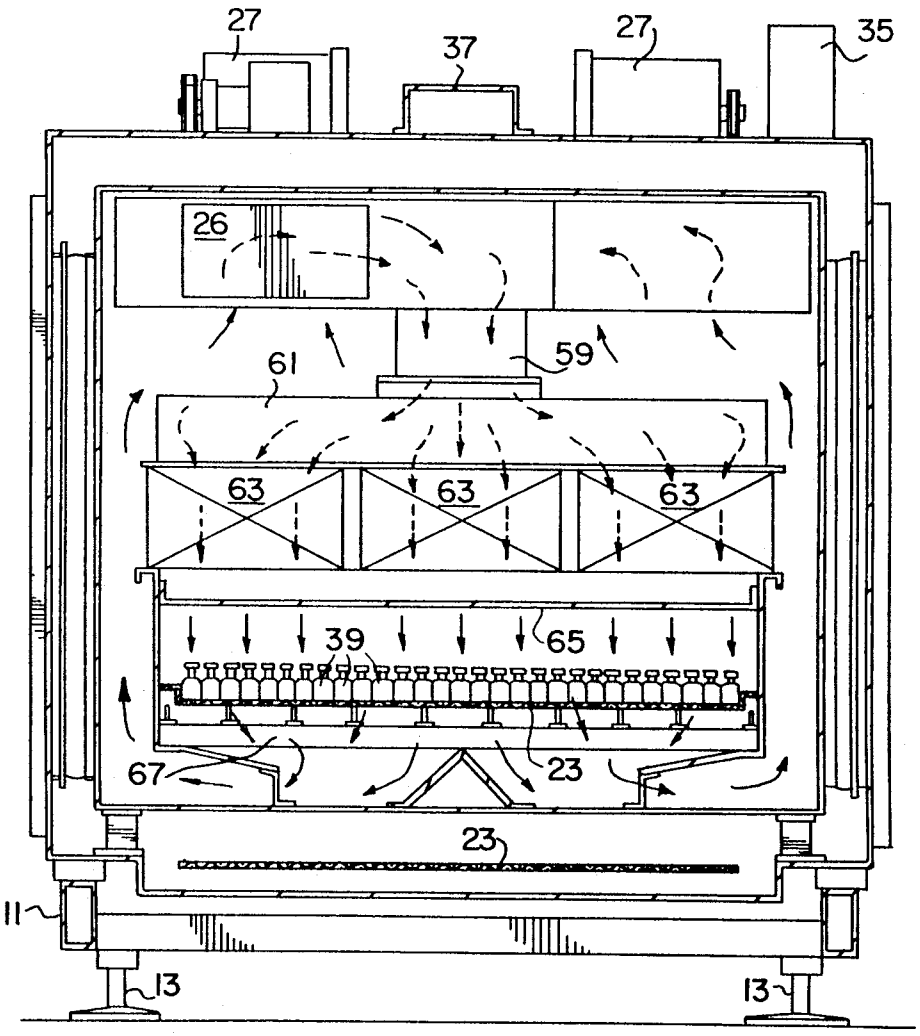
FIG. 5 is a transverse sectional elevational view taken along the lines 5—5 of FIG. 3*a*, showing additional details of the sterilization portion of the tunnel.

Heated air is then driven from the duct 57 by fan 25 and fan motor 27 into manifolds 59 which distribute air to the two plenum chambers 61. Air in the plenum chambers is directed through filters 63 and porous plate 65 as shown in FIG. 5, for example. Bottles 39 are impacted with hot filtered laminar flowing air at temperatures up to 350° C., thereby completely sterilizing the bottles. Air then continues to flow to the lower chamber 67 of the sterilization zone and then flows back along the sides of the sterilization zone chamber, being pulled by the fan 25 into duct 57.

Sterilization is complete and the bottles 39 pass through end wall 69, again with an adjustable gate 71 providing minimum clearance for the bottles, in order to preserve separation between the sterilization zone and the cooling zone which follows.

It is particularly important to avoid having heated sterilized air exiting through wall 69 and therefore the pressure in the succeeding cooling zone is slightly higher than the pressure in the sterilization zone. It is necessary to control this pressure, however, so that pressure from the filling room further on down the line or from the cooling zone itself does not cause unwanted flow back into the sterilization zone.

In the present invention, as shown in detail in FIG. 3*a*, a baffle 73 is positioned in duct 37 to control the amount of air which flows from the cooling zone to the preheat zone, to be expelled through exhaust stack 33. Baffle 73 is connected by linkage 74 to a pressure sensor/controller 75 which senses the differential of air pressure between the cooling zone inside and outside. High pressure causes the damper 73 to open and lower pressure causes damper 73 to close. If the damper 73 were to stay open, expensive sterile air would be drawn out of the fill room further downstream or possibly out of the sterilization zone. If the damper remains closed conditions which might result in blow back are created. For that reason pressure in the cooling zone is continuously monitored by sensor 75 and the damper is adjusted as needed.

Figure 3B:
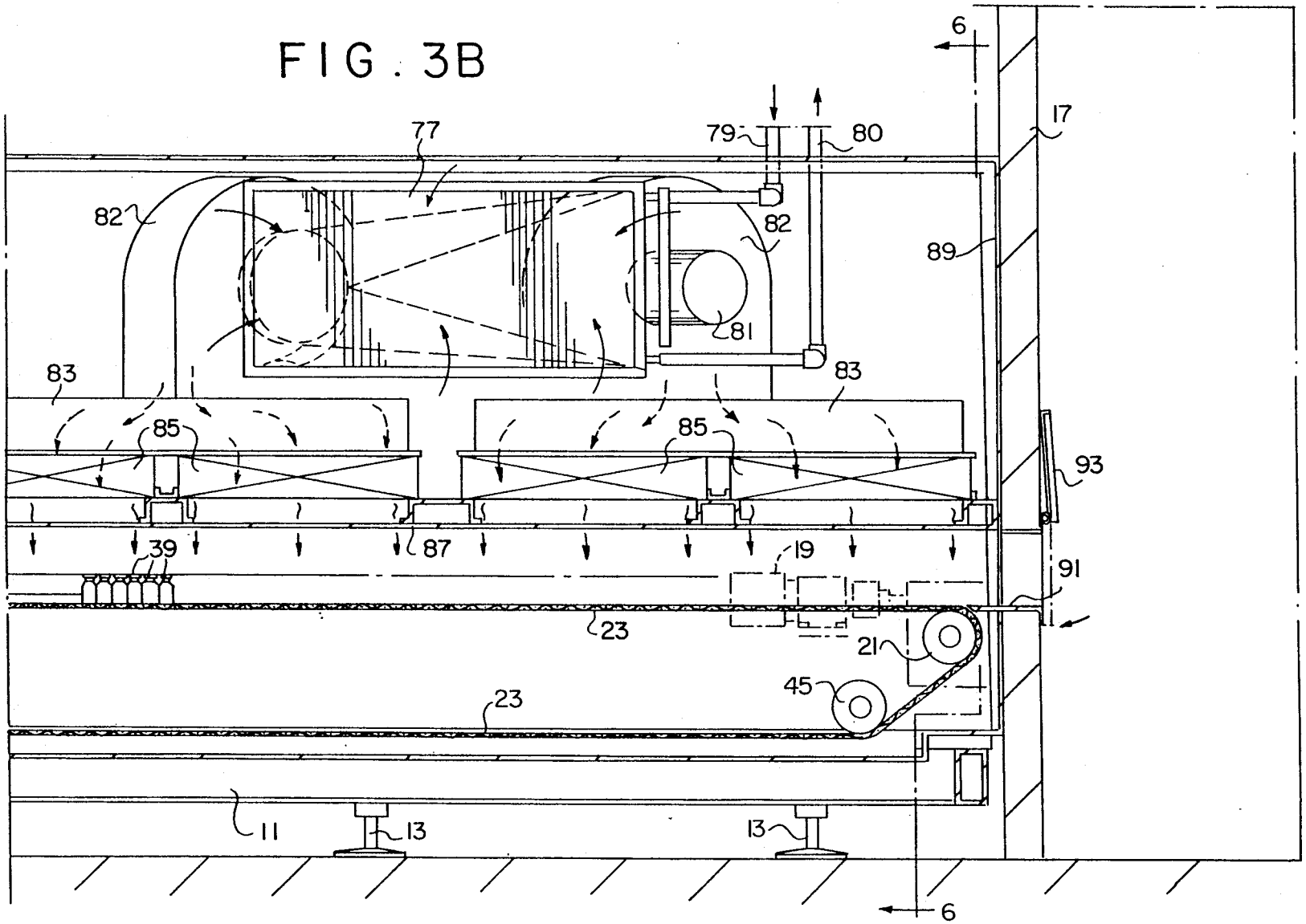
FIG. 3*b* is an enlarged fragmentary sectional elevational view taken along the line 3*b*—3*b* of FIG. 2.

The remaining portion of the cooling zone is shown in FIG. 3*b*. Cooling box 77 is provided with recycled coolant by pipe line 79 and withdrawn via pipeline 80. Motor 81 and fan 82 draws air from the zone across the cooling coils in cooling box 77, reducing the temperature to a range of between about 20° C. and about 80° C. Fan 82 forces the cooled air into plenum 83, which then passes through filters 85 and a perforated plate 87, impinging on bottles 39 to cool them to a cool temperature, such as about 20° C.

At the end of the cooling zone, wall 89 includes a dead plate 91 onto which bottles 39 are deposited by conveyor chain 23. Bottles can then be removed from dead plate 91 for filling, packaging, or other purposes as needed. When the system is shut down, door 93 may be closed to contain the system and prevent loss of filtered air.

Figure 7:
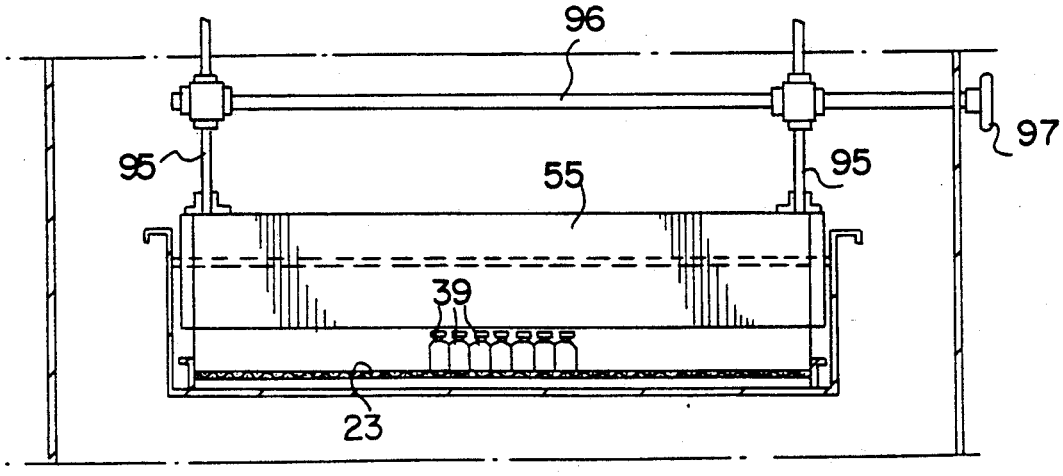
FIG. 7 is a fragmentary transverse sectional elevational view taken along the line 7—7 of FIG. 3*a*, showing additional details of the adjustable gate construction.

As has previously been described, the bottles 39 are intended to pass through walls 50 and 69, with an adjustable gate 55 and 71 respectively providing minimum clearance between the bottles and the gate. As shown in FIG. 7, bottles 39 are carried along by continuous chain conveyor 23 and just barely clear the bottom of gate 55. Gate 55 is attached to rods 95 which hold the gate in position and which are geared to a shaft 96. Rotation of shaft 96 by turning hand wheel 97 adjusts the height of the gate 55. Of course, the gate height can be adjusted automatically by providing a motorized gate and sensors, with programmed logic designed to provide the minimum amount of clearance possible.

In summary, it can be seen that the operation of the present invention provides for improved and effective treatment of bottles from a bottle washing facility through a sterilization tunnel and onto other processing steps. Bottles entered on the inlet side into a preheat zone and are carried from a dead plate onto a endless conveyor belt. In the inlet zone, warm filtered air impinges on bottles 39. These bottles enter into the sterilization portion of the apparatus, passing through a narrow gate sized to limit the available space for the bottles to pass to the minimum needed.

Air which has been heated to sterilizing temperature and has been filtered to remove substantially all particles is then impinged upon the bottles to sterilize them. Air is recycled in the chamber.

Bottles then leave the sterilization zone and are cooled by air which has again been filtered and has been cooled, thereby bringing the bottles to an exit dead plate from which they are removed.

The pressure in the cooling zone is monitored and a baffle is adjusted to vary the amount of air pressure in the cooling zone by releasing air to a duct which transports air to the preheat zone exhaust stack.

The preheat zone also monitors temperature, and causes air to be exhausted from the zone as the temperature rises. Thus blow back and damage to the washing equipment or other precursor devices is avoided.

While particular embodiments of the present invention have been illustrated and described herein, it is not intended to limit the invention and changes and modifications may be made therein within the scope of the following claims.

What is claimed is:

1. Apparatus for sterilizing objects, comprising:

an enclosed chamber having an inlet and an outlet, and including walls defining and separately enclosing a preheat zone, a sterilization zone and cooling zone respectively between said inlet and said outlet;

conveyor means for conveying objects along a path from said inlet through said zones to said outlet;

said preheat zone including exhaust means for discharging air from said apparatus, said exhaust means including temperature sensor means for adjusting the amount of exhaust air based upon the temperature in said preheat zone; and said cooling zone including recirculating means for directing air from said cooling zone to said exhaust means, and regulating means to control the amount of air directed by said recirculating means based upon air pressure in said cooling zone.

2. The apparatus of claim 1, which further includes gate means between said inlet zone and said sterilization zone to regulate the size of the conveyor path height for different objects carried on said path.

3. The apparatus of claim 1 which further includes gate means between said sterilization zone and said cooling zone to regulate the size of the conveyor path height for different objects carried on said paths.

4. The apparatus of claim 1 wherein said sterilization zone includes resistance heating coil means for heating air in said sterilization zone.

5. The apparatus of claim 1, wherein said cooling zone includes cooling coil means and fan means for drawing air across said cooling coils.

6. The apparatus of claim 1, which further includes dead plate means at said inlet and outlet for respectively transferring objects onto and off of said conveyor.

7. Apparatus for sterilizing objects, comprising:

an enclosed chamber having an inlet and an outlet, and including walls defining and separately enclosing a preheat zone, a sterilization zone and cooling zone respectively between said inlet and said outlet;

conveyor means for conveying objects along a path from said inlet through said zones to said outlet;

said preheat zone including air inlet means said preheat zone also including means for directing said air on objects on said path, said preheat zone further including an exhaust means for discharging air from said apparatus, said exhaust means including temperature sensor means for adjusting the amount of exhaust air based upon the temperature in said preheat zone;

said sterilization zone including means for directing heat filtered air from within said zone on object; and said cooling zone including recirculating means for directing air from said cooling zone to said exhaust means, and regulating means to control the amount of air directed by said recirculating means based upon air pressure in said cooling zone.

8. The apparatus of claim 7, which further includes gate means between said inlet zone and said sterilization zone to regulate the size of the conveyor path height for different objects carried on said path.

9. The apparatus of claim 7 which further includes gate means between said sterilization zone and said cooling zone to regulate the size of the conveyor path height for different objects carried on said paths.

10. The apparatus of claim 7 wherein said sterilization zone includes resistance heating coil means for heating air in said sterilization zone.

11. The apparatus of claim 7, wherein said cooling zone includes cooling coil means and fan means for drawing air across said cooling coils.

12. The apparatus of claim 7, which further includes dead plate means at said inlet and outlet for respectively transferring objects onto and off of said conveyor.

13. Apparatus for sterilizing objects, comprising:

an enclosed chamber having an inlet and an outlet, and including walls defining and separately enclosing a preheat zone, a sterilization zone and cooling zone respectively between said inlet and said outlet;

conveyor means for conveying objects along a path from said inlet through said zones to said outlet;

said preheat zone including air inlet means, also including means for directing said air on objects on said path, said preheat zone further including exhaust means for discharging air from said apparatus, said exhaust means including temperature sensor means for adjusting the amount of exhaust air based upon the temperature in said preheat zone;

said sterilization zone including means for directing heat filtered air from within said zone on object;

said cooling zone including means for directing cooled air from within said zone onto said objects, said cooling zone further including recirculating means for directing air from said cooling zone to said exhaust means, and regulating means to control the amount of air directed by said recirculating means based upon air pressure in said cooling zone; and first gate means between said inlet zone and said sterilization zone to regulate the size of the conveyor path height for different objects carried on said path; and second gate means between said sterilization zone and said cooling zone to regulate the size of the conveyor path height for different objects carried on said paths.

14. The apparatus of claim 13 wherein said sterilization zone includes resistance heating coil means for heating air in said sterilization zone; and wherein said cooling zone includes cooling coil means and fan means for drawing air across said cooling coils.

15. The apparatus of claim 13, which further includes dead plate means at said inlet and outlet for respectively transferring objects onto and off of said conveyor.

* * * * *